United States Patent [19]

Mori

[11] 4,449,229

[45] May 15, 1984

[54] SIGNAL PROCESSING CIRCUIT

[75] Inventor: Shuichi Mori, Saitama, Japan

[73] Assignee: Pioneer Electronic Corporation, Saitama, Japan

[21] Appl. No.: 313,845

[22] Filed: Oct. 22, 1981

[30] Foreign Application Priority Data

Oct. 24, 1980 [JP] Japan ..... 55-149147
Oct. 24, 1980 [JP] Japan ..... 55-149149

[51] Int. Cl.[3] ..... H04H 5/00
[52] U.S. Cl. ..... 381/2; 307/529
[58] Field of Search ..... 179/10, 1 G, 1 GP, 1 J; 307/529; 333/28 T; 381/2–4, 10, 13, 17

[56] References Cited

U.S. PATENT DOCUMENTS 3,124,649 3/1964 Pflager et al. ..... 179/1 GP

FOREIGN PATENT DOCUMENTS 54-12702 1/1979 Japan ..... 179/1 G
55-35582 3/1980 Japan ..... 179/1 G
1040574 9/1966 United Kingdom ..... 179/1 J

*Primary Examiner*—A. D. Pellinen
*Attorney, Agent, or Firm*—Sughrue, Mion, Zinn, Macpeak & Seas

[57] ABSTRACT

A signal processing circuit capable of producing a pair of output signals having a correlated coefficient from a single irregular input signal. When such output signals are used for reproduction in an audio equipment, sounds are emanated from loudspeakers, so as to provide an auditor with a directional, spatial sensation.

6 Claims, 2 Drawing Figures

SIGNAL PROCESSING CIRCUIT

BACKGROUND OF THE INVENTION

The present invention relates to signal processing circuit, and more particularly to a signal processing circuit suitable for use as a stereo signal processing circuit.

In a stereo system of a compact type, loudspeakers are positioned fairly close in distance with each other so that a stereophonic effect is not sufficiently created. In order to overcome this drawback, a variety of techniques have been proposed in the art. Yet, none of these are satisfactory. One of these conventional techniques contemplates by way of correcting a transfer function to add a directional, spatial sensation in the reproduced sound as if the reproduced sound emanates from the loudspeakers greatly spaced from each other. In correcting the transfer function, however a listening position is previously determined, so that the effect is greatly varied in the listening positions outside the predetermined position.

SUMMARY OF THE INVENTION

Accordingly, an object of this invention is to provide a signal processing circuit which produces signals to enhance a directional, spatial sensation.

This invention has been made in view of the fact that the directional, spatial sensation when listening to the reproduced sound should correspond to the correlation coefficient of the signals to be reproduced. A specific feature of the invention resides in that an input signal, such as an audio signal, which is irregular in normal state (hereinafter referred to as "an irregular signal") and a delayed signal of the input signal are used to produce first and second non-correlated signals having a zero correlation coefficient. The first and second signals are attenuated by first and second variable attenuators, respectively. The outputs of the two attenuators are subjected to addition to provide a first additive output, and the inverted output of the first attenuator and the output of the second attenuator are added to provide a second additive output. The ratio of the attenuation factors of the first and second attenuators is controlled so that the correlation coefficient of these two additive outputs is set to a desired value.

According to a preferred embodiment of this invention, left and right channel stereo signals are added and the resultant additive output is filtered to provide a particular band signal. The particular band signal thus obtained is processed and separated into two signals which have a correlation coefficient approximately equal to a correlation coefficient of the auditor's ears in the diffused sound spatial field. Such correlated signals are respectively added to the left and right channel stereo signals from which the particular band signal is eliminated, thereby providing complete stereo reproducing output signals.

DESCRIPTION OF THE PREFERRED EMBODIMENTS

This invention will now be described with reference to the accompanying drawings.

Figure 1:
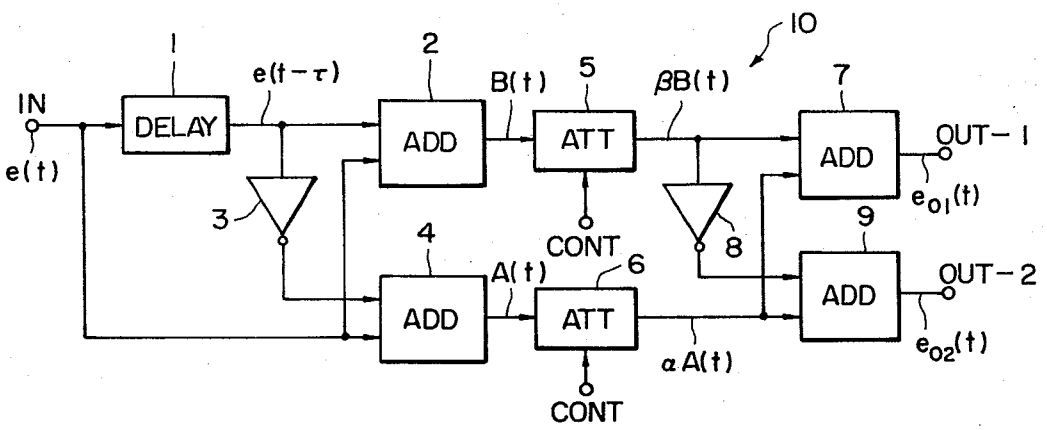
FIG. 1 is a block diagram showing a signal processing circuit in accordance with the invention.

FIG. 1 is a block diagram showing a signal processing circuit according to the invention. In the circuit, two signals OUT-1 and OUT-2 having a correlation coefficient are obtained from an irregular signal on an input terminal IN. The irregular signal e(t) is applied to one input terminal of an addition circuit 2 through a delay element 1, and the output of the delay element 1 is applied through a phase inversion circuit 3 to one input terminal of an addition circuit 4. Furthermore, the irregular signal e(t) is applied directly to the other input terminals of the addition circuits 2 and 4. The outputs A(t) and B(t) of addition circuits 4 and 2 are attenuated by variable attenuators 6 and 5, the attenuation factors $\alpha$ and $\beta$ of which are controlled by control signals CONT, respectively. The output of the attenuator 5 is applied directly to one input terminal of an addition circuit 7 and is further applied to one input terminal of an addition circuit 9 with the phase inverted by a phase inversion circuit 8. The output of the attenuator 6 is applied to the other input terminals of the addition circuits 7 and 9. Thus, the outputs OUT-1 and OUT-2 of the addition circuits 7 and 9 are used as a pair of signals having a desired correlation coefficient.

If a signal delay time in the delay element 1 is represented by $\tau$, then the outputs A(t) and B(t) of the addition circuits 4 and 2 are:

$$A(t)=e(t)-e(t-\tau) \qquad (1)$$

$$B=e(t)+e(t-\tau)$$

Signals A(t) and B(t) represent, respectively, difference and sum signals. In general, the correlation coefficient R of two irregular signals x(t) and y(t) is:

$$R=\frac{\overline{x(t)\cdot y(t)}}{\sqrt{\overline{x(t)^2}\cdot\overline{y(t)^2}}} \qquad (2)$$

where $\overline{x(t)^2}$ and $\overline{y(t)^2}$ are the time averages of $x(t)^2$ and $y(t)^2$, respectively, and $\overline{x(t)\cdot y(t)}$ is the time average of $x(t)\cdot y(t)$.

Therefore, the correlation coefficient of the two signals of expression (1) can be expressed as follows:

$$R=\frac{\lim_{T\to\infty}\frac{1}{T}\int_0^T\{e(t)-e(t-\tau)\}\{e(t)+e(t-\tau)\}dt}{\left(\lim_{T\to\infty}\frac{1}{T}\int_0^T\{e(t)-e(t-\tau)\}^2dt\times\lim_{T\to\infty}\frac{1}{T}\int_0^T\{e(t)+e(t-\tau)^2dt\right)^{\frac{1}{2}}} \qquad (3)$$

The numerator of expression (3) can be transformed as follows:

$$\lim_{T\to\infty}\frac{1}{T}\int_0^T\{e(t)\}^2dt-\lim_{T\to\infty}\frac{1}{T}\int_0^T\{e(t-\tau)\}^2dt$$

As e(t) and $e(t-\tau)$ are the irregular signals, the numerator becomes zero. Thus, it can be understood that the two signals A(t) and B(t) are non-correlated signals having a zero correlation coefficient.

The outputs $e_{01}(t)$ and $e_{02}(t)$ of the addition circuits 7 and 9 are represented as follows:

$$e_{01}(t)=\alpha\cdot A(t)+\beta\cdot B(t) \qquad (4)$$
$$e_{02}(t)=\alpha\cdot A(t)-\beta\cdot B(t)$$

Signals $e_{01}(t)$ and $e_{02}(t)$ represent, respectively, sum and difference signals. Therefore, by using expression (2), the correlation coefficient of the two outputs can be represented by the following expression:

$$R=\frac{\lim_{T\to\infty}\frac{1}{T}\int_0^T\{\alpha\cdot A(t)+\beta\cdot B(t)\}\{\alpha\cdot A(t)-\beta\cdot B(t)\}dt}{\left(\lim_{T\to\infty}\frac{1}{T}\int_0^T\{\alpha\cdot A(t)+\beta\cdot B(t)\}^2dt\times\lim_{T\to\infty}\frac{1}{T}\int_0^T\{\alpha\cdot A(t)-\beta\cdot B(t)\}^2dt\right)^{\frac{1}{2}}} \qquad (5)$$

If expression (5) is arranged by using the following relations (6), the following expression (7) is obtained:

$$\left.\begin{aligned}&\lim_{T\to\infty}\frac{1}{T}\int_0^T A(t)\cdot B(t)dt=0\\&\lim_{T\to\infty}\frac{1}{T}\int_0^T\{A(t)\}^2dt=\lim_{T\to\infty}\frac{1}{T}\int_0^T\{B(t)\}^2dt\\&\beta/\alpha=H\end{aligned}\right\} \qquad (6)$$

$$R=\frac{1-H^2}{1+H^2} \qquad (7)$$

When H ($=\beta/\alpha$) in expression (7) is changed from zero to $+\infty$, then the correlation coefficient R of the outputs $e_{01}(t)$ and $e_{02}(t)$ changes continuously in a range from $-1$ to $+1$. Accordingly, if the ratio of the attenuation factors ($H=\beta/\alpha$) is set to a suitable value upon controlling the attenuation factors $\alpha$ and $\beta$ of the attenuators 5 and 6 with the control signals CONT, then two signals $e_{01}(t)$ and $e_{02}(t)$ having a desired correlation coefficient can be obtained from a single irregular signal e(t).

Figure 2:
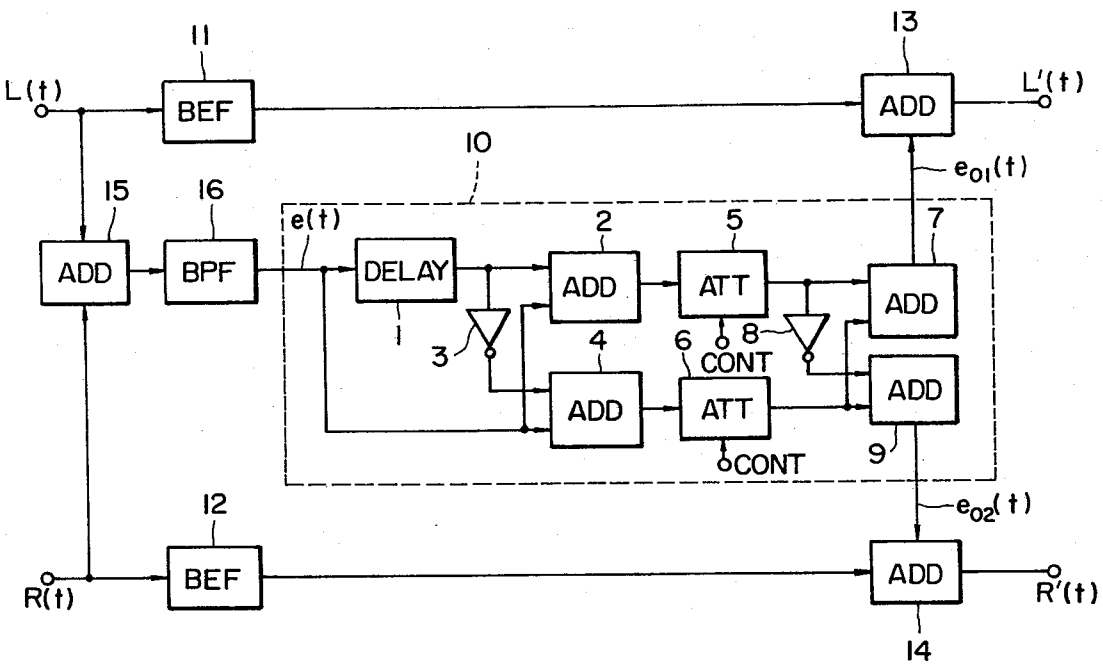
FIG. 2 is a block diagram showing a preferred embodiment applied to a stereo reproducing device in accordance with the invention.

FIG. 2 is a block diagram showing one preferred embodiment of the invention in which stereo reproduction signals are processed by the signal processing circuit 10 described with reference to FIG. 1 to create a directional, spatial sensation. In FIG. 2, like components shown in FIG. 1 are designated by like reference numerals or characters.

Left and right channel stereo signals L(t) and R(t) for reproduction are applied through BEFs (band-elimination filters) 11 and 12 to input terminals of addition circuits 13 and 14, respectively. The BEFs serve to eliminate a particular band signal, thus the left and right channel signals from which the particular band signal is eliminated are applied to the input terminals of the addition circuits 13 and 14, respectively. The channel signals L(t) and R(t) are subjected to addition in an addition circuit 15, and the resultant output L(t)+R(t) is applied to a BPF (band-pass filter) 16 which passes a particular band signal, i.e. it extracts from the output of addition circuit 15 only the particular band signal and passes this extracted signal to the processing circuit 10. The output of the BPF 16 in the form of the irregular signal e(t) is applied to the signal processing circuit 10 described with reference to FIG. 1, and two signals $e_{01}(t)$ and $e_{02}(t)$ are obtained, the correlation coefficient of which is set to a desired value. These two signals $e_{01}(t)$ and $e_{02}(t)$ are applied to the other input terminals of the above-described addition circuits 13 and 14, respectively. The additive outputs of the addition circuits 13 and 14 are used as left and right channel reproduction signals L'(t) and R'(t) to drive the loudspeaker system.

By effecting the signal processing as described, the directional, spatial sensation can be created even in a stereo system in which the distance between the loudspeakers is relatively small. Fundamentally, the ratio H of the attenuation factors of the attenuators 5 and 6 are controlled so that the correlation coefficient of the auditor's ears relative to the sound emanating from the loudspeakers becomes approximately equal to the correlation coefficient in a diffused sound spatial field.

In the above-described embodiment, only the middle frequency components which greatly contribute to the enhancement of the directional, spatial sensation are processed by the signal processing circuit 10, because the low frequency components are liable to be subjected to tone color variation by the delay element 1 and the high frequency components do not greatly contribute to the enhancement of the directional, spatial sensation. The BPF 16 is provided to permit the middle frequency components of the left and right channel stereo signals to be applied to the signal processing circuit 10. The outputs of the signal processing circuit 10 are applied to the addition circuits 13 and 14 to which the left and right channel stereo signals from which the middle frequency components are eliminated by the BEFs 11 and 12, are also applied, respectively. Thus, the addition circuits 13 and 14 provide complete band stereo signals with a desired correlation coefficient.

With the signal processing circuit as described, the reproduction sound spatial field of stereo-radio cassette recorder or of a sound multiplex TV set can be greatly expanded.

What is claimed is:

1. A signal processing circuit comprising:

non-correlated signal generating means for generating first and second signals from an irregular input signal and a signal obtained by delaying said irregular input signal, said first and second signals being not correlated with each other and having a zero correlation coefficient;

first and second variable attenuator means for attenuating said first and second signals, respectively;

first addition means for subjecting outputs of said first and second variable attenuator means to addition; and second addition means for adding an inverted output of said second variable attenuator means to said output of said first variable attenuator means; and wherein a ratio of attenuation factors of said first and second variable attenuator means is controlled so that the correlation coefficient of output signals of said first and second addition means is set to a desired value.

2. A circuit as defined in claim 1, wherein said non-correlated signal generating means comprises:

delay means for delaying said irregular input signal and providing a delayed output signal;

third addition means for adding a signal obtained by inverting said delayed output signal to said irregular input signal; and fourth addition means for adding said delayed output signal to said irregular input signal, and wherein said third and fourth addition means provide said first and second signals, respectively.

3. A stereo reproducing device comprising:

means for subjecting particular band signals of two channel stereo signals to addition to provide an additive signal and extracting a particular band signal from said additive signal;

correlated signal generating means for generating two correlated signals having a desired correlation coefficient by using said extracted particular band signal and a delayed signal obtained by delaying said extracted particular band signal; and means for adding said two correlated signals respectively to said two channel stereo signals from which said particular band signal is eliminated to output channel stereo reproducing signals.

4. A device as defined in claim 3, wherein said correlated signal generating means comprises:

non-correlated signal generating means for generating first and second signals from said additive signal and said delayed signal, said first and second signals being not correlated with each other and having a zero correlation coefficient;

first and second variable attenuator means for attenuating said first and second signals, respectively;

first addition means for subjecting outputs of said first and second variable attenuator means to addition; and second addition means for adding an inverted output of said second variable attenuator means to said output of said first variable attenuator means, and wherein outputs of said first and second addition means provide said two correlated signals.

5. A device as defined in claim 4, wherein said non-correlated signal generating means comprises:

third addition means for adding a signal obtained by inverting said delayed signal to said additive signal; and fourth addition means for adding said delayed signal to said additive signal, and wherein outputs of said third and fourth addition circuits provide said first and second signals, respectively.

6. A signal processing circuit, comprising:

a signal input (IN) for receiving an input signal;

delay means (1) for delaying said input signal to provide a delayed signal;

first combining means (2) for generating a first signal corresponding to the sum of said input and delayed signals;

second combining means (3, 4) for generating a second signal corresponding to the difference between said delayed and input signals;

first attenuating means (5) for variably attenuating said first signal;

second attenuating means (6) for variably attenuating said second signal;

third combining means (7) for generating a first output signal corresponding to the sum of the output signals of said first and second attenuating means; and fourth combining means (8, 9) for generating a second output signal corresponding to the difference between the output signals of said first and second attenuating means.

* * * * *